United States Patent [19]

Konsolas

[11] 4,095,800

[45] Jun. 20, 1978

[54] MAP BOARD GAME APPARATUS

[76] Inventor: Yannis Konsolas, 342 E. 49th St., Apt. D, New York, N.Y. 10017

[21] Appl. No.: 731,903

[22] Filed: Oct. 13, 1976

[51] Int. Cl.[2] ..... A63F 3/04

[52] U.S. Cl. ..... 273/251

[58] Field of Search ..... 273/134

[56] References Cited

U.S. PATENT DOCUMENTS

| | | | |
|---|---|---|---|
| 866,447 | 9/1907 | Falkenberg | 273/134 AC |
| 940,855 | 11/1909 | Clemens | 273/134 AC |
| 1,005,095 | 10/1911 | Yost | 273/134 AC UX |
| 1,329,812 | 2/1920 | Stoll | 273/134 AC |
| 3,949,991 | 4/1976 | Chase | 273/134 AC |

*Primary Examiner*—Richard C. Pinkham
*Assistant Examiner*—Harry G. Strappello
*Attorney, Agent, or Firm*—Peter Kent

[57] ABSTRACT

A game apparatus comprising a game board having a map including a plurality of selected countries each distinguishable from the others by the color thereof. A path is superimposed on the game board map including a plurality of first stopping points and one second stopping point in each country corresponding to the capital city of the country. A plurality of movable game members are used for moving along the path and a selector is used for effecting movement of the game members along the path. The selector includes a base and a pointer rotatably mounted thereon and wherein the base has an inner radial band thereon divided into a plurality of selectable segments each having indicia thereon for instructing the movement of a game member a number of points along the path and an outer radial band concentric with the inner band and divided into a plurality of equal size selectable segments each having indicia thereon associated with a different one of the countries for instructing the moving of a game member to the second stopping point in the country associated therewith.

8 Claims, 9 Drawing Figures

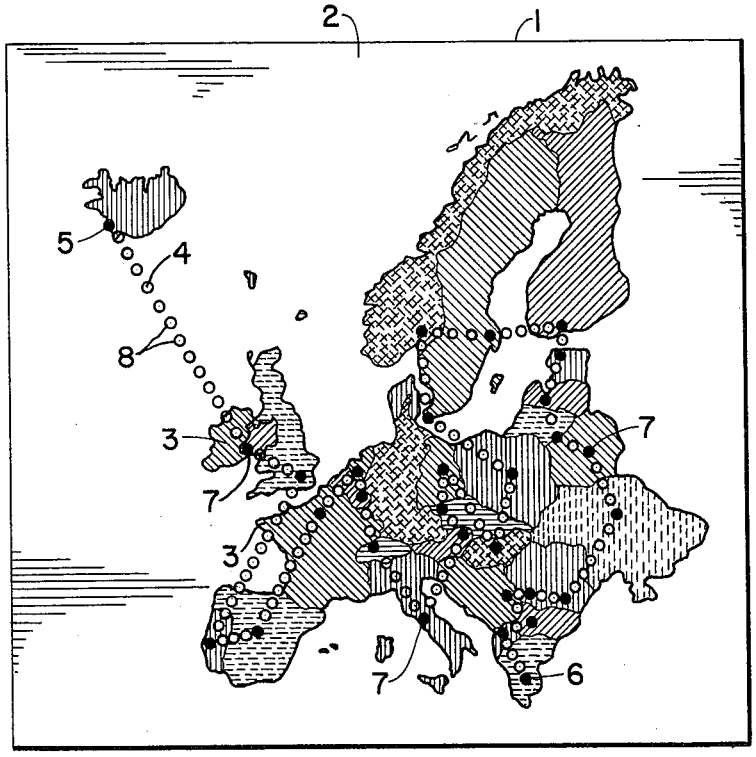
FIG. 1
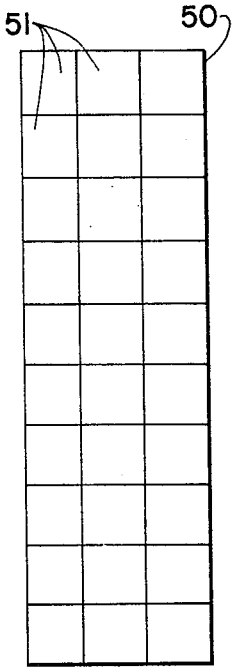
FIG. 7
FIG. 2
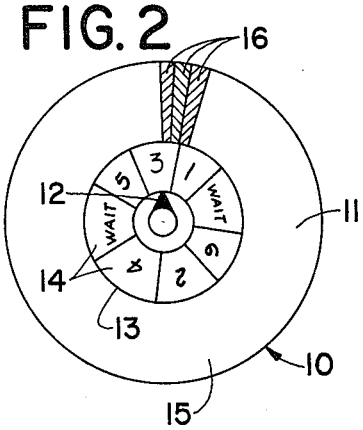
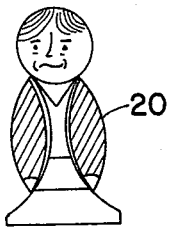
FIG. 3
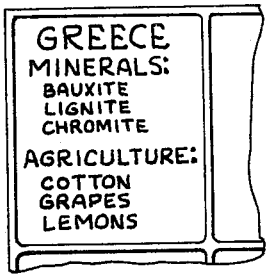
FIG. 8
FIG. 4
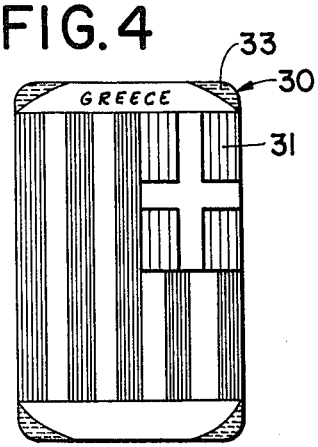
FIG. 5
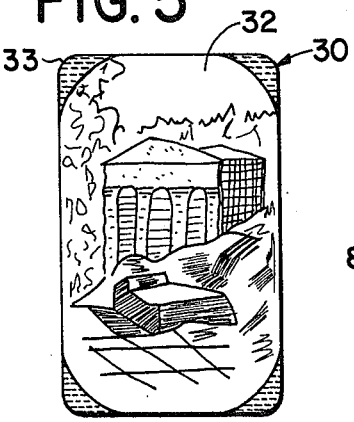
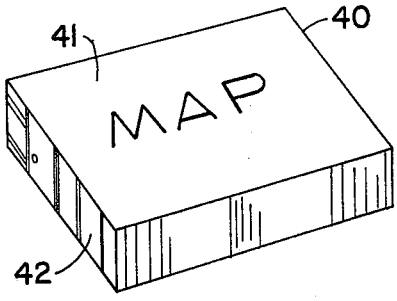
FIG. 6
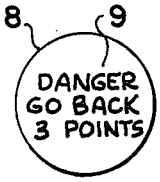
FIG. 1a

MAP BOARD GAME APPARATUS

BACKGROUND OF THE INVENTION

The present invention relates to a game apparatus.

Game apparatuses are known in the prior art which include a map with a path thereon, but these apparatuses have the disadvantage of not being able to impart cultural and factual knowledge about the various countries shown on the map while the game is being played.

Among the known prior art apparatuses that provide a map but do not provide a rotatable selector are U.S. Pat. Nos. 866,447; 940,855; 1,144,927; 1,635,734; 2,128,608 and 3,883,142.

U.S. Pat. Nos. 952,997 and 1,329,812 disclose a map and a rotatable spinner, but neither teach the use of a spinner for instructing the movement of a game member to a particular stopping point in a country indicated on the selector.

SUMMARY OF THE INVENTION

The main object of the present invention is to provide a game apparatus which overcomes the disadvantages of the prior art apparatuses and which is both interesting and informative and which provides a game board and a selector for selecting movement along the path and for directing movement to a particular stopping point in a particular country on the map.

These and other objects are achieved by the apparatus of the present invention including a game board having a map and means defining a path on the game board map, a plurality of movable game members for moving along the path and selecting means for effecting movement of the game members along the path.

BRIEF DESCRIPTION OF THE DRAWING

In the drawings which constitute a part of the specification, the embodiments demonstrating the various objectives and features of the present invention are set forth as follows:

FIG. 1 is a top view of the game board of the game apparatus;

FIG. 1*a* is an enlarged view of one of the points of the game board:

FIG. 2 is a top view of the selector of the game apparatus;

FIG. 3 is a front view of the game member of the present invention;

FIG. 4 is a view of one side of a game card of the present invention;

FIG. 5 is a view of the other side of the game card shown in FIG. 4;

FIG. 6 is a perspective view of the box for the game apparatus;

FIG. 7 is a top view of the card box of the game apparatus; and

FIG. 8 is an enlarged top view of a portion of the card box.

DETAILED DESCRIPTION OF THE PREFERRED EMBODIMENTS

FIG. 1 shows a game board having a map of Europe thereon. Each country 3 is preferably labelled and each country 3 is preferably shaded in a different color so that each is distinguishable from the other countries on the map. Superimposed on the map 2 on game board 1 is a path 4 extending between and through all of the countries 3 on the map 2. The path 4 has a starting point 6 corresponding to Athens, Greece and a finising point 5 corresponding to Reykjavik, Iceland. Between the starting and finishing points are a plurality of first stopping points 8 and second stopping points 7 of which there is one per country and which corresponds to the capital city of that country.

The first stopping points 8 are all one color such as white and all of the second stopping points 7 are a different color than the first stopping points 8 such as black and preferably have the names of the cities written thereon. In the preferred embodiment, the map 2 includes 30 European countries and 30 second stopping points 7 corresponding to the capital cities of each of the 30 countries.

Also, selected ones of the first stopping points 8 have signs 9 thereon which direct movement along the path such as: wrong way — go back to the previous city; danger — go back three points; hitch hike — advance three points; accident — go back five points; shortcut — go ahead five points; train crossing or boat crossing — lose your turn.

FIG. 2 is a top view of the selecting means 10 which includes a base 11 having a rotatable pointer 12 thereon. On the base is a first radial band 13 which is divided into segments 14 each corresponding to a number of moves along the path 4. For example, the number "5" means that one would move 5 points along the path while "wait" signifies that one would move no points along the path. Concentric with band 14 is radial band 15 divided into 30 equal size segments 16. The segments 16 each have indicia thereon associating it with one of the countries 3 on map 2. In the preferred embodiment, each segment 16 has a flag of one of the countries thereon.

FIG. 3 shows game member 20 which includes a pawn which preferably has the shape of a person. A plurality of game members 20 are provided each having a different color so that they are distinguishable.

FIGS. 4 and 5 show the two sides of a game card 30 of the present invention. A plurality of cards 30 are provided for each country and in the preferred embodiment, there are twenty cards for each country totalling 600 cards all told. FIGS. 4 and 5 show an example of one card for Greece. Side 31 of card 30 includes the flag of Greece in the central portion thereof and the name and population at either end of the flag. Around the border thereof 33, the card has a color corresponding to the color of the country on the map 2. The other side of the card 32 shows one cultural aspect of the country and preferably a description of that aspect. For example on the card for Greece, there is shown a picture of Delphi and information is given as to the period in which it was constructed in which in and by whom and where.

FIG. 6 shows the box 40 of the game apparatus which preferably has the map of Europe on the cover 41 and the 30 flags of Europe along the side border 42 thereof.

FIG. 7 shows the card box 50 which is disposable in the game box 40 and which holds the game cards 30. The card box 50 is divided into 30 compartments 51, each for holding a plurality of cards for a given country 3. In the preferred embodiment, each compartment 51 holds each twenty cards for each of the thirty countries. In the preferred embodiment, the bottom of the card box has general information about the country associated therewith for example the mineral resources, agricultural products, etc.

In use, each player takes a turn to rotate the pointer 12 of the selector 10 and the player with the highest number starts the game. All of the game members 20 are located at the starting point 6. Each of the players in turn rotates the pointer 12 successively and moves the game member 20 the number of points indicated in inner band 13.

Each player moves along the board on the path 4 along points 7 and 8 and when a player reaches a stopping point 7, it signifies that the capital city of that country in which it is situated has been reached and the player collects one card 30 which describes the cultural aspects of the country.

While moving along the board the player must obey all signs 9 that appear with the stopping points 8 as described heretofore. When a player reaches another player at the same stopping point 7 or 8, he gets all of that other player's cards and the place. The player who has lost the place must now rotate the pointer 12 and then must go back to the capital city stopping point 7 of the country indicated on the outer band 15 by the selected segment 16. At that point the player collects one card 30 from that country and continues to play.

All of the players must travel throughout Europe and the first player to reach the last city gains ten cards from that city, the second player to finish gains five cards from the city, the third player gains three cards, the fourth player and all of those thereafter only one card. The player with the most cards wins the game.

While preferred embodiments of the invention have been shown by way of example in the drawings, it will be understood that the invention is in no way limited to these embodiments.

I claim:

1. A game apparatus comprising:

a. a game board having a map including a plurality of selected countries each distinguishable from the others by the color thereof and means defining a path on the game board map including a plurality of first stopping points and one second stopping point in each country corresponding to the capital city of the country;

b. a plurality of movable game members for moving along said path; and c. selecting means for effecting movement of the game members along the path including a base and a pointer rotatably mounted thereon, wherein said base has an inner radial band thereon divided into a plurality of selectable segments each having indicia thereon for instructing the moving of a game member a number of points along the path and an outer radial band concentric with the inner band and divided into a plurality of equal size selectable segments each having indicia thereon associated with a different one of said countries for instructing the moving of a game member to the second stopping point in the country associated therewith.

2. A game apparatus according to claim 1, further comprising a plurality of cards for each country distributable upon the reaching of a second stopping point in that country by a game member, each card having a border thereon having the same color as that of the associated country on the map.

3. A game apparatus according to claim 2, wherein each card has information about its associated country on the front and back thereof.

4. A game apparatus according to claim 3, wherein each of said first stopping points are a first color and each of said second stopping points are a second color distinguishable from said first color.

5. A game apparatus according to claim 4, wherein said path includes a starting point and a finishing point.

6. A game apparatus according to claim 5, further comprising a card box having a plurality of compartments therein each for holding the plurality of cards for one different country and each having information on the bottom thereof relating to the associated country.

7. A game apparatus according to claim 6, wherein each of said game members includes a pawn having a color different than the others.

8. A game apparatus according to claim 7, wherein selected ones of said first stopping points have indicia thereon comprising instruction for movement of the game members landing thereon.

* * * * *